US005620048A

United States Patent [19]

Beauquin

[11] Patent Number: 5,620,048

[45] Date of Patent: Apr. 15, 1997

[54] OIL-WELL INSTALLATION FITTED WITH A BOTTOM-WELL ELECTRIC PUMP

[75] Inventor: Jean-Louis Beauquin, Saint Faust, France

[73] Assignee: Elf Aquitaine Production, France

[21] Appl. No.: 536,790

[22] Filed: Sep. 29, 1995

[30] Foreign Application Priority Data

Sep. 30, 1994 [FR] France ..... 94 11750

[51] Int. Cl.[6] ..... E21B 43/00

[52] U.S. Cl. ..... 166/62; 166/66.4; 166/106; 417/417; 417/423.3

[58] Field of Search ..... 166/106, 66.4, 166/57, 62; 417/417, 423.3, 423.7

[56] References Cited

U.S. PATENT DOCUMENTS

| | | | |
|---|---|---|---|
| 1,840,994 | 1/1932 | Winsor . | |
| 2,725,824 | 12/1955 | Arutunoff | 417/423.3 |
| 2,739,650 | 3/1956 | Hill | 166/106 |
| 4,266,607 | 5/1981 | Halstead | 166/244 |
| 4,413,958 | 11/1983 | Webb | 417/424 |
| 4,538,970 | 9/1985 | Rabson | 417/417 |
| 4,548,552 | 10/1985 | Holm | 417/417 |
| 4,687,054 | 8/1987 | Russell et al. | 166/66.4 |
| 4,768,595 | 9/1988 | Smith | 166/66.4 X |
| 4,815,949 | 3/1989 | Rabson | 417/417 |
| 4,928,771 | 5/1990 | Vandevier | 166/385 |
| 5,049,046 | 9/1991 | Escue et al. | 417/411 |
| 5,193,985 | 3/1993 | Escue et al. | 417/53 |
| 5,482,117 | 1/1996 | Kolpak et al. | 166/106 X |

FOREIGN PATENT DOCUMENTS

| | | | |
|---|---|---|---|
| 115902 | 10/1978 | Japan | 417/423.7 |
| 964111 | 10/1982 | Russian Federation | 166/106 |
| 165773 | 12/1958 | Sweden | 417/423.7 |
| 448449 | 6/1936 | United Kingdom | 417/423.3 |
| 2112872 | 7/1983 | United Kingdom . | |

*Primary Examiner*—Hoang C. Dang
*Attorney, Agent, or Firm*—Bacon & Thomas

[57] ABSTRACT

Oil-well installation extending from the surface (14) to an oil-bearing rock stratum (16) comprising a tubing (20), arranged in the well and forming a flow channel to the surface for hydrocarbons originating from the oil-bearing rock stratum, a casing (18) delimiting the wall of the well, and a seal (24) arranged at the well bottom between the tubing (20) and the casing (18) so as to form a chamber (26) isolated from the hydrocarbons, the installation furthermore comprising, in the well, a pump (30, 48) and an electric motor (34, 46) which is intended to actuate the pump. According to the invention, the stator (40, 52) of the electric motor (34, 46) is arranged outside the tubing (20) and isolated thereby from the hydrocarbons flowing inside the tubing.

7 Claims, 2 Drawing Sheets

FIG. 2A
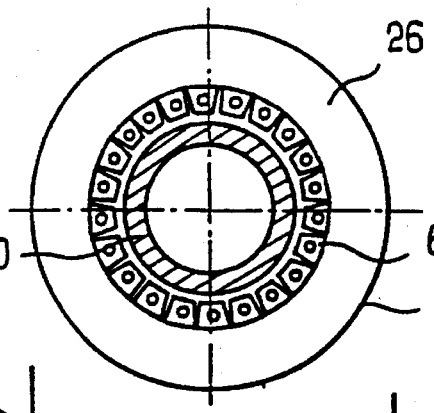
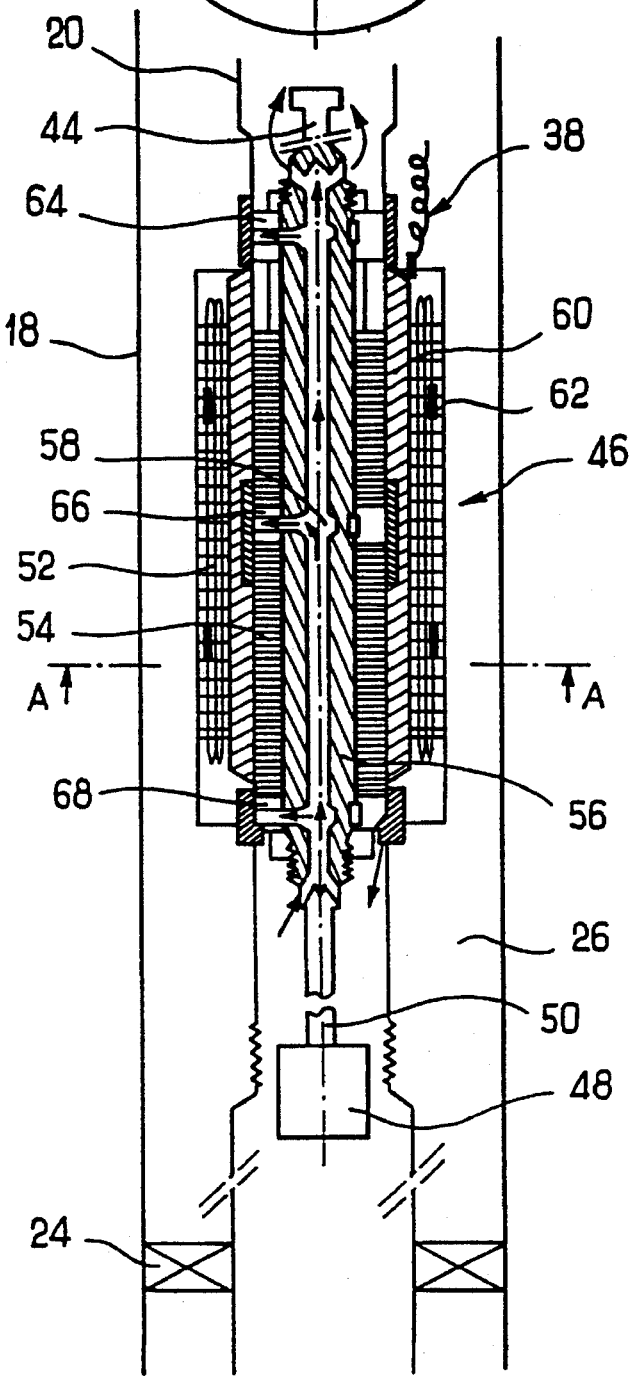
FIG. 2

OIL-WELL INSTALLATION FITTED WITH A BOTTOM-WELL ELECTRIC PUMP

BACKGROUND OF THE INVENTION

1. Field of the Invention

The present invention relates to an oil-well installation fitted with an electric pump at the well bottom.

2. Description of Related Art

In some oil wells, the natural flow of the hydrocarbons from the bottom to the surface proves insufficient to allow or maintain commercial production. This is due either to the high viscosity of the hydrocarbons or to an excessively low natural pressure at the bottom of the well, or else to a combination of the two. In order to allow the well to enter production on a commercial scale, an assistance system or an activation system for the well may be used. For example, a pump may be provided at the lower end of a production tube located in the well. This pump can be operated by an electric motor immersed at the bottom of the well, which is powered by a cable arranged in the annular space between the tubing and the casing of the well.

When making an inventory survey of the sources of breakdowns in electric pumps immersed at the well bottom which require withdrawal of a tubing, the following are found in order:

electrical short-circuits (approximately 80%), mechanical wear, mechanical failure.

Of course, some short-circuits arise when first starting up and result from a fault during installation which requires a great deal of care and knowhow.

However, most short-circuits take place during use and result from normal progressive degradation of the electrical insulation barriers, since the pumps are immersed in the effluent extracted from the oil-bearing rock.

The power range and the installation depth require high voltages, which may be up to 1000 to 3000 volts, in order to minimize losses in the cables. However, these high voltages make the installations vulnerable.

Damage to solid insulators results from phenomena which are easy to understand:

- Working the well necessarily generates pressure and temperature variations, due to stoppages and to changes in working conditions, in the regions where the pumping equipment is located, thereby creating mechanical stress cycles in the constituent materials.
- The pressure variations also cause repeated gas migrations within the insulators, which tend to degrade their structure and their performance.
- The presence of hydrocarbons, aromatic compounds, acid gases and the like causes various chemical attacks on the various mechanical or electrical insulation barriers, thus contributing to their degradation over time.
- The variations (in particular stopping and starting the motor) in electric current flowing through the electrical conductors generate, by the Joule effect, significant temperature variations which accelerate ageing of the electrical insulators.
- The high voltages mentioned above generate strong stress fields on all the insulators.

The second cost factor for using electric pumps immersed at the bottom of a well is that, in order to repair a breakdown, all the electrical cable and the tubing to which the bottom unit is coupled must be raised back up. Current bottom-well electric pumps actually constitute compact tubular blocks assembled at the surface before they are lowered into the well. These systems must consequently be raised integrally with the tubing when carrying out maintenance. This operation requires service equipment which is expensive to mobilize, especially on sites with difficult access (those which are isolated, at sea, underwater or urban sites). The waiting time and operating time also generate significant production losses. This is true to the extent that these systems cannot be considered in the most difficult cases.

All these factors dramatically affect the cost of this pumping method and even economically rule out the development of certain marginal oil fields.

A sucker-rod pumping installation consists of a positive displacement pump which is installed in the tubing and has its piston moved in translation from the surface by means of steel or glass-fibre rods. At the surface, the movement is imparted to the rod line by a rocker structure driven by a rotary electric motor or else a hydraulic jack.

The intrinsic weight, the inertia, the friction and the mechanical fatigue of the rods limit the pumping capacity and performance of these systems. They are ill-suited to flowing wells, for which bottom safety components are required, to deep wells or to high flow rates (greater than 200 $m^3$/d of liquid).

The monobloc design of current bottom electric pumps is beneficial in the case of wells where the handling operation is easy and inexpensive, which is the case for drinking-water wells, non-flowing on-shore or shallow wells. It is not suited to current and future oil wells. These are increasingly deep, inaccessible, dangerous (because blowout often occurs), and are fitted with complex equipment which is difficult to install. It is becoming desirable to concentrate the unavoidable weaknesses such as mechanical wear in an independent module which would be more lightweight and less expensive to raise up and replace, with a cable or a winch for example.

Given that most causes of breakdown are due to the fact that the electrical part is immersed in a hostile environment, it would be desirable to group the whole of the electrical part in an enclosure shielded from any attack which could lead to electrical breakdowns. This would leave in contact with the effluents only the "mechanical" components which cannot cause or suffer electrical short-circuits and can be raised up independently and replaced for the purpose of maintenance, following mechanical wear, or for flexibility in order to adapt, for example, to a change in the effluents from the well or the working conditions.

SUMMARY OF THE INVENTION

The subject matter of the present invention is therefore an oil-well installation which makes it possible to separate the electrical part from the mechanical parts of an electric pump unit immersed in the well, to place the electrical part in an enclosure shielded from external attack, due in particular to the bottom-well effluents, and to group the mechanical parts together in order to make it easier to withdraw them.

In order to do this, the invention provides an oil-well installation extending from the surface to an oil-bearing rock stratum comprising a tubing, arranged in the well and forming a flow channel to the surface for hydrocarbons originating from the oil-bearing rock stratum, a casing delimiting the wall of the well, and a seal arranged at the well bottom between the tubing and the casing so as to form a chamber isolated from the hydrocarbons, the installation furthermore comprising, in the well, a pump and an electric motor which is intended to actuate the pump characterized in that the stator of the electric motor is arranged outside the tubing and isolated thereby from the hydrocarbons flowing inside the tubing.

The electric motor may be a rotary motor or a linear motor.

According to a preferred embodiment, the pump is placed upstream of the electric motor.

The present invention has the advantage of creating a sealing barrier, impenetrable to the effluent, between the central mobile part and the windings of the stator. This barrier is technologically simpler and more reliable than current dynamic ones, because it is a static barrier of the wall type through which a mobile part (shaft or rod) transmitting the movement to the mobile part of the pump no longer passes.

The mobile part of the motor can be installed and withdrawn independently of the fixed part, and in particular of the electrical equipment, and furthermore this involves simple cable operation which facilitates mechanical maintenance and reduces working costs.

Other characteristics and advantages of the present invention will emerge on reading the following description, given by way of explanation but without limitation, and with reference to the attached drawings,

DESCRIPTION OF THE DRAWINGS

FIG. 2 is a sectional view of an oil-well installation according to a second aspect of the invention; and FIG. 2A is a sectional view, taken on the line A—A in FIG. 2.

DETAILED DESCRIPTION OF THE PREFERRED EMBODIMENT

Figure 1:
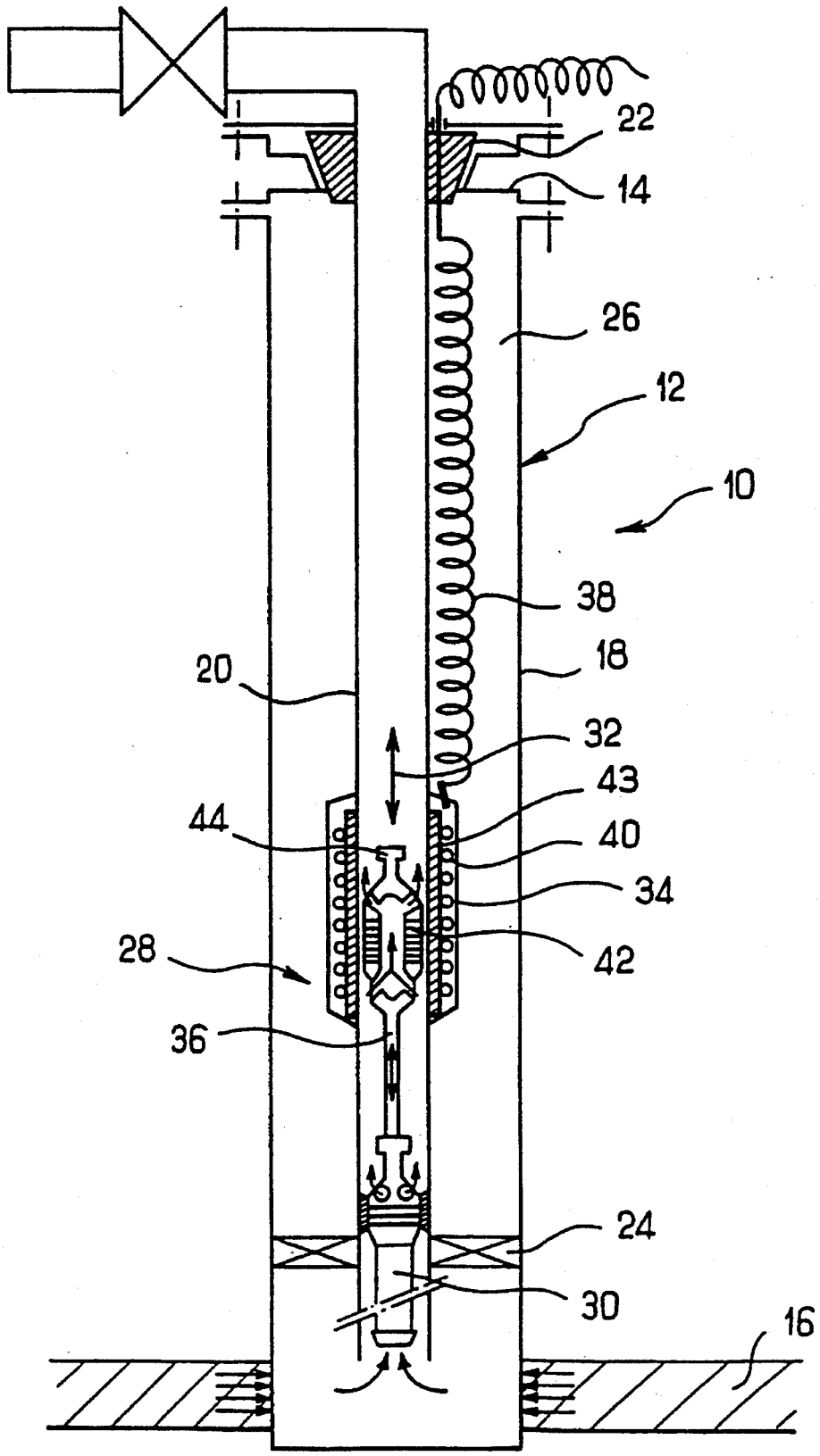
FIG. 1 is a sectional view of an oil-well installation according to a first aspect of the invention.

FIG. 1 represents, overall at 10, an oil-well installation in which a well 12 extends between the surface 14 and an oil-bearing rock stratum 16. The well 12 includes a casing 18 which seals the well from the rock strata through which the well passes. Inside the well, a production tubing 20 extends between a well head, schematically represented at 22, and a seal 24, more commonly termed a "packer", which is, for example, arranged at approximately 100 m above the level of the oil-bearing rock 16. A leaktight chamber 26 is defined between the external wall of the tubing 20 and the internal wall of the casing 18.

In the example illustrated, the tubing 20 includes, at its lower end, a pumping assembly represented overall at 28, which comprises a reciprocating pump 30 intended to be actuated in the direction of the arrow 32 by a linear electric motor 34 via a piston rod 36. The linear electric motor 34 is powered from the surface 14 via an electrical cable 38 arranged in the chamber 26.

The linear motor 34 comprises a stator 40 and a mobile part 42 which can be moved under the effect of the magnetic field generated by the stator. According to the invention, the stator 40 is mounted outside the tubing 20 and inside the chamber 26. At least in the region 43 neighbouring the linear motor 34, the tubing 20 is formed from non-magnetic material which, in a preferred example, is a ceramic. The mobile part 42 is fitted at its upper end with a coupling head 44 which makes it possible to raise the mobile part 42 as well as the pump 30 to the surface, for example by means of a cable.

The motor is cooled by the extracted effluent which passes through the mechanical part of the motor, flowing either through the air gap between the mobile part and the fixed stator, or at the centre of the mobile part which is then hollow.

The chamber 26 containing the electrical part may, in a preferred embodiment, hold a dielectric substance, a liquid or a gel, in order further to reinforce the durability of the installation. Using a gel also has the advantage of thermally insulating the tubing, which then receives all the heat dissipated in the cable 38 lying along it, for which it acts as a radiator. This heating will ensure better overall energy efficiency of the installation because the flows are heated.

As represented in FIG. 1, it is preferable to place the pump 30 under the motor 34, which affords advantages for certain types of viscous effluents or those containing gas, improving the performance of the well. Indeed, the act of placing the pump under the motor markedly reduces the head losses before the effluent enters the pump.

Lubrication between the mobile and fixed parts takes place either in the dry state with suitable materials (ceramic, zirconium, teflon, carbides or bronze), or with a film of effluent set in place by a hydrodynamic effect. A parallel lubrication system could also be installed.

The installation according to the invention avoids electrical penetration of the seal or "packer" which was until now unavoidable and constituted a source of the major electrical breakdowns of systems used to date.

A second embodiment is represented in FIG. 2, in which the elements common to the installation of FIG. 1 have the same reference numbers. A rotary motor, represented overall at 46, is connected to a conventionally designed rotary pump, schematically represented at 48, by a rod 50. As in the case of the installation in FIG. 1, the fixed part of the rotary motor 46, in particular the stator 52, is arranged outside the tubing 20, and only the mobile part lies inside the tubing in the corrosive and reactive medium constituted by the hydrocarbons and the well effluents. The mobile part of the rotary motor comprises a rotor 54 arranged around a shaft 56 provided with a longitudinal passage 58. The section 60 of the tubing 20 located between the windings 62 of the stator 52 and the rotor 54 is formed from a non-magnetic material, so as not to disturb the magnetic field passing through it.

The shaft 56 is mounted so that it can rotate freely in the tubing 20 by means of upper 64, central 66 and lower 68 axial thrust bearings. The bearings 64, 66, 68 are each provided with a radial passage which communicates with the longitudinal passage 58 and which guarantees lubrication of the bearings. As in the embodiment of FIG. 1, the mobile part of the motor includes, at its upper end, a coupling head 44 making it possible to raise the mobile part of the motor as well as the pump 48 to the surface. This operation is carried out conventionally using a cable from the surface.

The installation according to the invention thus makes it possible to isolate the electrical part of motors from the hydrocarbons or effluents passing through the interior of the tubing 20, which hydrocarbons constitute a corrosive environment. This type of installation makes it possible to reduce the number of electrical breakdowns considerably, while allowing easy replacement of the mobile parts of the installation.

I claim:

1. Oil-well installation extending from the surface to an oil-bearing rock stratum comprising a tubing arranged in the well and forming a flow channel to the surface for hydrocarbons originating from the oil-bearing rock stratum, a casing delimiting the wall of the well, a seal arranged at the well bottom between the tubing and the casing so as to form a chamber isolated from the hydrocarbons, a pump and an electric motor which actuates the pump in the well, said electric motor comprising an electrical portion including a stator and a cable supplying electrical power from the surface and a mechanical portion including a mobile part which is movable under the effect of the magnetic field generated by the stator, wherein the stator and the cable of the electric motor are arranged in the chamber isolated from the hydrocarbons and wherein the chamber contains a dielectric substance in the form of a liquid or gel.

2. Installation according to claim 1, wherein the tubing is formed of non-magnetic material over at least the length where the tubing passes through the electric motor.

3. Installation according to claim 1 wherein the electric motor is of the linear type.

4. Installation according to claim 1 wherein the electric motor is of the rotary type.

5. Installation according to claim 1 wherein the pump is arranged upstream of the electric motor.

6. Installation according to claim 1 wherein the mobile part of the electric motor includes a coupling head intended to allow the said mobile part and the pump to be raised back to the surface.

7. Installation according to claim 1, wherein the motor is cooled by the extracted effluent which passes through the mechanical portion between the mobile part and the stator.

* * * * *